US007048177B1

(12) United States Patent
Franklin

(10) Patent No.: US 7,048,177 B1
(45) Date of Patent: May 23, 2006

(54) DUAL COMPARTMENT MAILBOX CONSTRUCTION

(76) Inventor: Presley L. Franklin, 1111 Cedar Creek Rd., Fayetteville, NC (US) 28312

( * ) Notice: Subject to any disclaimer, the term of this patent is extended or adjusted under 35 U.S.C. 154(b) by 0 days.

(21) Appl. No.: 10/915,887

(22) Filed: Aug. 11, 2004

(51) Int. Cl.
*B65D 91/00* (2006.01)

(52) U.S. Cl. ..... 232/17; 232/45

(58) Field of Classification Search ..... 232/17, 232/20, 21, 27, 45, 38, 39
See application file for complete search history.

(56) References Cited

U.S. PATENT DOCUMENTS

| | | | | |
|---|---|---|---|---|
| 3,706,411 | A | 12/1972 | Klein | 232/17 |
| 3,891,139 | A | 6/1975 | Redling | 232/35 |
| 4,848,650 | A | 7/1989 | Roberts, II | 232/17 |
| 4,905,891 | A * | 3/1990 | Wildish et al. | 232/17 |
| 5,056,711 | A | 10/1991 | Bush | 232/17 |
| 5,143,284 | A * | 9/1992 | Socarras | 232/21 |
| 5,148,974 | A * | 9/1992 | Clapper | 232/17 |
| 5,178,320 | A | 1/1993 | Bertone | 232/17 |
| 5,645,215 | A * | 7/1997 | Marendt et al. | 232/17 |
| 6,629,634 | B1 * | 10/2003 | Simmons | 232/45 |
| 2004/0232215 | A1 * | 11/2004 | Monette et al. | 232/19 |

* cited by examiner

*Primary Examiner*—William L. Miller
(74) *Attorney, Agent, or Firm*—Sturm & Fix LLP

(57) ABSTRACT

A dual compartment mailbox construction (10) including an elongated hollow housing member (20) having a front door member (43) and a pair of side door members (40) (40') wherein, the interior of the housing member (20) is provided with an elongated divider plate (30) that defines upper and lower quadrangular compartments (50) (50') for receiving and separating envelopes from bulk mail items that may be retrieved from either of the side door members (40) (40').

2 Claims, 2 Drawing Sheets

Fig. 4
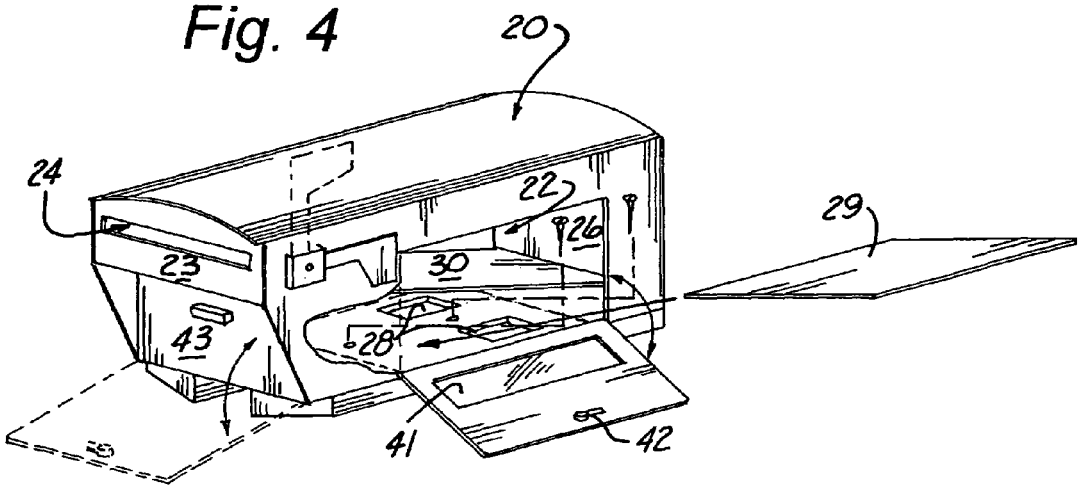
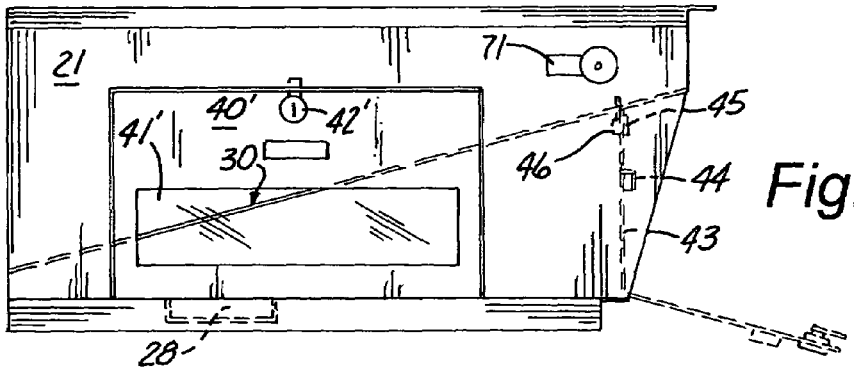
Fig. 5
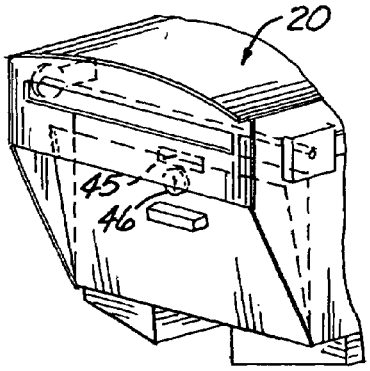
Fig. 6
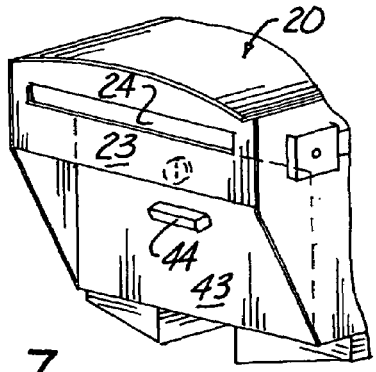
Fig. 7

DUAL COMPARTMENT MAILBOX CONSTRUCTION

BACKGROUND OF THE INVENTION

1. Field of the Invention

The present invention relates to the field of mailbox constructions in general and in particular to a dual compartment mailbox construction.

2. Description of Related Art

As can be seen by reference to the following U.S. Pat. Nos. 5,178,320; 5,056,711; 4,848,650; 3,891,139, and, 3,706,411, the prior art is replete with myriad and diverse compartmented mailbox constructions.

While all of the aforementioned prior art constructions are more than adequate for the basic purpose and function for which they have been specifically designed, they are uniformly deficient with respect to their failure to provide a simple, efficient, and practical dual compartment mailbox construction having an angled floor divider that segregates the compartments into separate mail receiving zones.

As most people are aware, bulk mail items should never be bunched with individual envelope letters that may contain photographs or greeting cards, the practical and/or sentimental value of which may be diminished by being folded, creased, or bent when combined with bulk mail items.

As a consequence of the foregoing situation, there has existed a longstanding need for a new and improved dual compartment mailbox construction having an angled divider floor that allows the mail to be retrieved from both the top and bottom compartments through either one of a pair of opposed side doors, and the provision of such a construction is the stated objective of the present invention.

BRIEF SUMMARY OF THE INVENTION

Briefly stated, the mailbox construction that forms the basis of the present invention comprises in general a housing unit having a plurality of access door units and an angled divider unit which defines upper and lower interior compartments that are accessible through one or more of the plurality of access door units.

As will be explained in greater detail further on in the specification, each of the access door units is provided with spring loaded pivot arms and two of the access door units are provided with observation windows.

Furthermore, the front access door unit is provided with a two stage closure arrangement wherein, the front access door unit may be either releasably retained via magnetic attraction or fully depressed into a secure, locked position.

As will also be explained in greater detail, the angled divider unit and the opposed access door units provide multiple access portals into the enlarged portions of each of the non-uniform angled compartments created in the interior of the mailbox housing unit.

In addition, the housing unit is provided with a dedicated envelope slot that feeds directly into the upper housing compartment wherein, the angled divider unit feeds the envelopes via gravity into the lower enlarged end of the upper compartment of the housing unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 4 is an isolated perspective view of the mailbox construction with one of the mirror image side access door units in the open position;

FIG. 5 is a right side elevation view of the mailbox construction;

FIG. 6 is a front perspective view of the front access door unit in its releasably closed position; and, FIG. 7 is a front perspective view similar to FIG. 6, but showing the front access door unit in its fully closed and locked position.

DETAILED DESCRIPTION OF THE INVENTION

Figure 1:
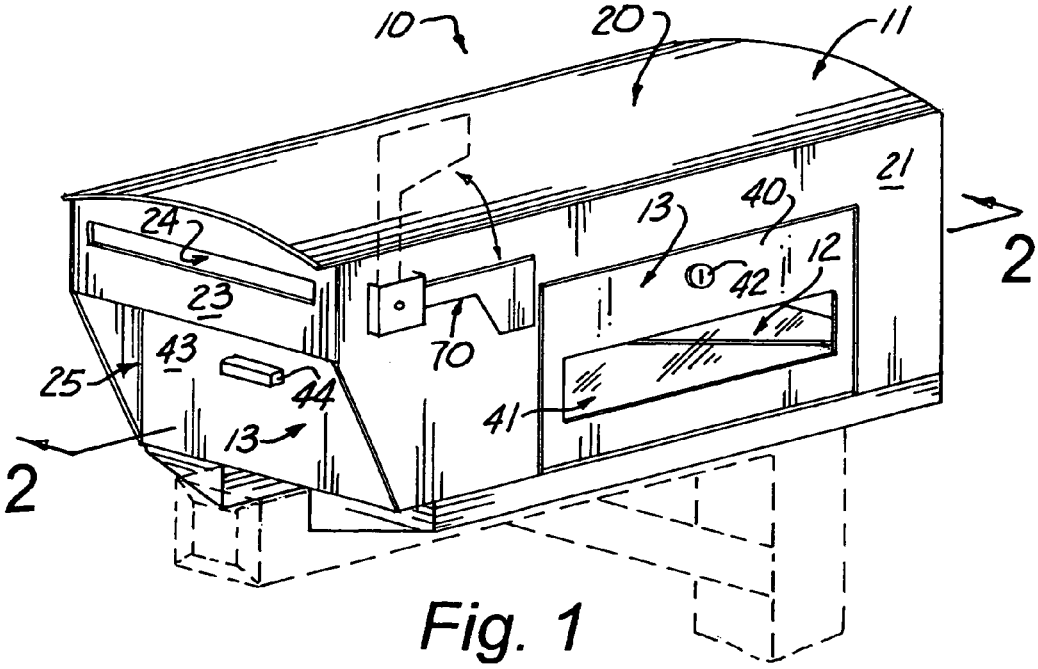
FIG. 1 is a perspective view of the dual compartment mailbox construction that forms the basis of the present invention.

As can be seen by reference to the drawings, and in particular to FIG. 1, the dual compartment mailbox construction that forms the basis of the present invention is designated generally by the reference number 10. The construction 10 comprises in general a housing unit 11, an angled divider unit 12, and a plurality of access door units 13. These units will now be described in seriatim fashion.

As shown in FIGS. 1,2, 4 and 5, the housing unit 11 comprises a generally elongated rectangular hollow housing member 20 having mirror image side panels 21 each provided with an enlarged rectangular side door opening 22 and a stepped shoulder front face panel 23 the upper portion of which is provided with a horizontally elongated envelope slot 24 and the lower recessed portion of which defines an enlarged rectangular front door opening 25.

Figure 2:
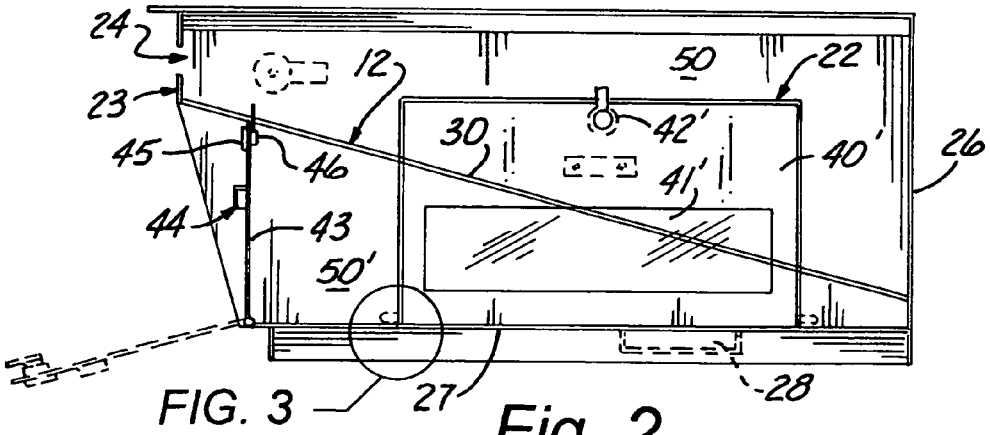
FIG. 2 is a left side cross-sectional view of the mailbox construction taken through line 2—2 of FIG. 1.

In addition, as can best be seen by reference to FIG. 2, the interior of the hollow housing member is provided with the angled divider unit 12 in the form an elongated rectangular divided plate 30 extending from the lower end of the upper portion of the front face panel 23 to a point on the rear panel 26 adjacent to but spaced from the floor panel 27.

Still referring to FIG. 2, it can best be seen that the floor panel 27 is further provided with a pair of conventional mounting apertures and a pair of recessed compartments 28 the presence of which is masked by a cover panel 29 depicted in FIG. 4.

As can also be appreciated by reference to FIGS. 1, 2, and 5, the plurality of access door units 13 comprise a pair of mirror image side door members 40 40'pivotally disposed in the side door openings 22 in the housing member 20 wherein, each of the side door members 40 40' is provided with observation windows 41' 41'and a lock mechanism 42 42'.

Furthermore, the plurality of access door units 13 also include a front door member 43 having a handle element 44, a magnetic latch element 45 and a lock mechanism 46 wherein, the magnetic latch element 45 will releasably maintain the front door member 43 in an upright, loosely closed position by virtue of its magnetic attraction to the underside of the metal divider member 30; or, the front door member 43 may be fully closed to fully engage the lock mechanism 46 in a well recognized manner as depicted in FIGS. 6 and 7.

Returning once more to FIG. 2, it can be appreciated that the divider member 30 defines an upper quadrangular envelope compartment 50 that widens as it approaches the rear panel 26 of the housing member 20 and, a lower quadrangular bulk mail compartment 50' that tapers downwardly as it approaches the rear panel 26 of the housing member 20.

Furthermore, the opposed side door members 40 40' provide easy access for the user from either side of the housing member 20 to the enlarged portions of both the upper 50 and lower 50' compartments to remove both individual envelopes and/or bulk mail from the housing member 20.

Figure 3:
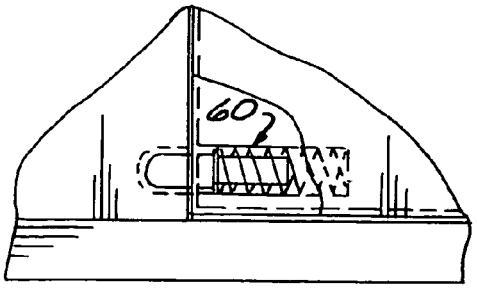
FIG. 3 is an isolated detail view of the spring loaded pivot pins associated with each of the access door units.

As can best be seen by reference to FIG. 3, each of the access door units 13 is further provided with a pair of spring loaded hinge pivot members designated generally as 60 which are seated in recesses formed both in the housing member 20, as well as, on the lower portion of the opposed sides of the front 43 as well as the pair of side 40 40' door members.

Turning now to FIGS. 1 and 5, it can also be seen that the housing member 20 is also provided with conventional signaling elements 70 71 that are disposed on opposite sides of the housing member 20 for the added convenience of both the mail delivery person and the mailbox owner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A dual compartment mailbox construction comprising a generally elongated hollow housing member having a front face panel provided with at least one enlarged door opening and a pair of opposed side panels wherein, each side panel is provided with an enlarged door opening;

an elongated divider plate angularly disposed within the hollow housing member to define an upper quadrangular envelope compartment and a lower quadrangular bulk mail compartment;

a plurality of access door units including a front door member disposed in said front face panel door opening and a side door member provided with an observation window and disposed in the door opening in each said side panel of the housing member;

both of said side door members are provided with observation windows;

all of said door members are provided with locking mechanisms;

the front face panel of the housing member has an elongated envelope slot disposed above the front face panel door opening;

the divider plate is disposed between the elongated envelope slot and the front door opening;

said front door member is further provided with a magnetic element that is attracted to said divider plate; and the housing member is further provided with a floor panel having mounting apertures and at least one recessed compartment that are concealed by a cover panel.

2. The construction as in claim 1; wherein, said housing member is further provided with a pair of signaling elements that are disposed on the opposed side panels of the housing member.

* * * * *